United States Patent [19]

Van de Moortele

BEST AVAILABLE COPY

[11] 3,945,772

[45] Mar. 23, 1976

[54] PUMPS FOR TRANSFERRING SMALL QUANTITIES OF DOSED LIQUIDS

[75] Inventor: Gudio Van de Moortele, Bridel, Luxemburg

[73] Assignee: Unitas S.A., Luxemburg, Luxemburg

[22] Filed: May 22, 1974

[21] Appl. No.: 472,195

[30] Foreign Application Priority Data

May 25, 1973 Belgium ..... 52798

[52] U.S. Cl. ..... 417/489; 92/60.5; 222/145; 222/385; 417/495; 417/503

[51] Int. Cl.[2]. F04B 23/00; F01B 31/14; B67D 5/56

[58] Field of Search ..... 417/264, 274, 489, 493, 417/494, 495, 503; 92/13.2, 13.4, 13.5, 60.5; 222/136, 137, 145, 385

[56] References Cited

UNITED STATES PATENTS

| | | | |
|---|---|---|---|
| 1,896,098 | 2/1933 | Poyer | 92/60.5 |
| 2,901,980 | 9/1959 | Jordan | 417/495 |
| 2,981,198 | 4/1961 | Nettel | 92/60.5 X |
| 3,217,936 | 11/1965 | Abplanalp | 222/145 X |
| 3,338,479 | 8/1967 | Marraffino | 222/136 X |
| 3,643,688 | 2/1972 | Meinert | 222/136 X |

*Primary Examiner*—William L. Freeh
*Assistant Examiner*—Leonard Smith
*Attorney, Agent, or Firm*—Ulle C. Linton

[57] ABSTRACT

The invention relates to a cylinder and plunger pump for transferring very small quantities of dosed liquids.

The purpose of the invention consists in the realization of relatively small pumps of which the piston need only perform a very small reciprocating movement in order to pump up the liquid, whereby no disturbances may occur.

4 Claims, 2 Drawing Figures

PUMPS FOR TRANSFERRING SMALL QUANTITIES OF DOSED LIQUIDS

DESCRIPTION

According to the main characteristic of the invention, use is made for this purpose of a pump which consists mainly of a cylinder provided at one end with an inlet bore with a valve for sucking up a liquid, and being open at the other end and in connection with a space for another liquid or gas which is at a higher pressure than the first mentioned, a plunger with axial bore and valve housing for evacuating the dosed liquid, means for obtaining an axial displacement between plunger and cylinder, whereby the plunger is alternately located within and outside of aforesaid cylinder, so that in the latter position of the plunger the liquid which has been brought into the cylinder is at same pressure as that which is in aforementioned space, in such a manner that a small displacement of the plunger is sufficient to pump up the liquid which is then evacuated through the plunger when the latter penetrates into the cylinder.

The fact of bringing the liquid which is present in the cylinder up to a higher pressure, does not merely offer as advantage that only a small displacement need be transmitted to the plunger for pumping up the liquid, but also that all compressible matters or gasses which are present, such as for instance air bubbles, are already compressed before the liquid is being transferred, so that they present no obstacle when the liquid is pumped up, and that the transfer can take place without disturbance, even with a very small displacement of the plunger. Another advantage of this pump is that, contrary to what occurs with the known pumps, it is no longer necessary to completely immerse this pump in the liquid which has to be pumped up in order to prevent the formation of air bubbles, and such due to the previously mentioned fact that the new pump permits the easy evacuation of any air bubbles which may be present.

Merely as an example, and without the slightest attempt at limitation, a more detailed description is given hereinafter of a possible form of embodiment of this pump. The description refers to the appended drawings in which.

Figure 1:
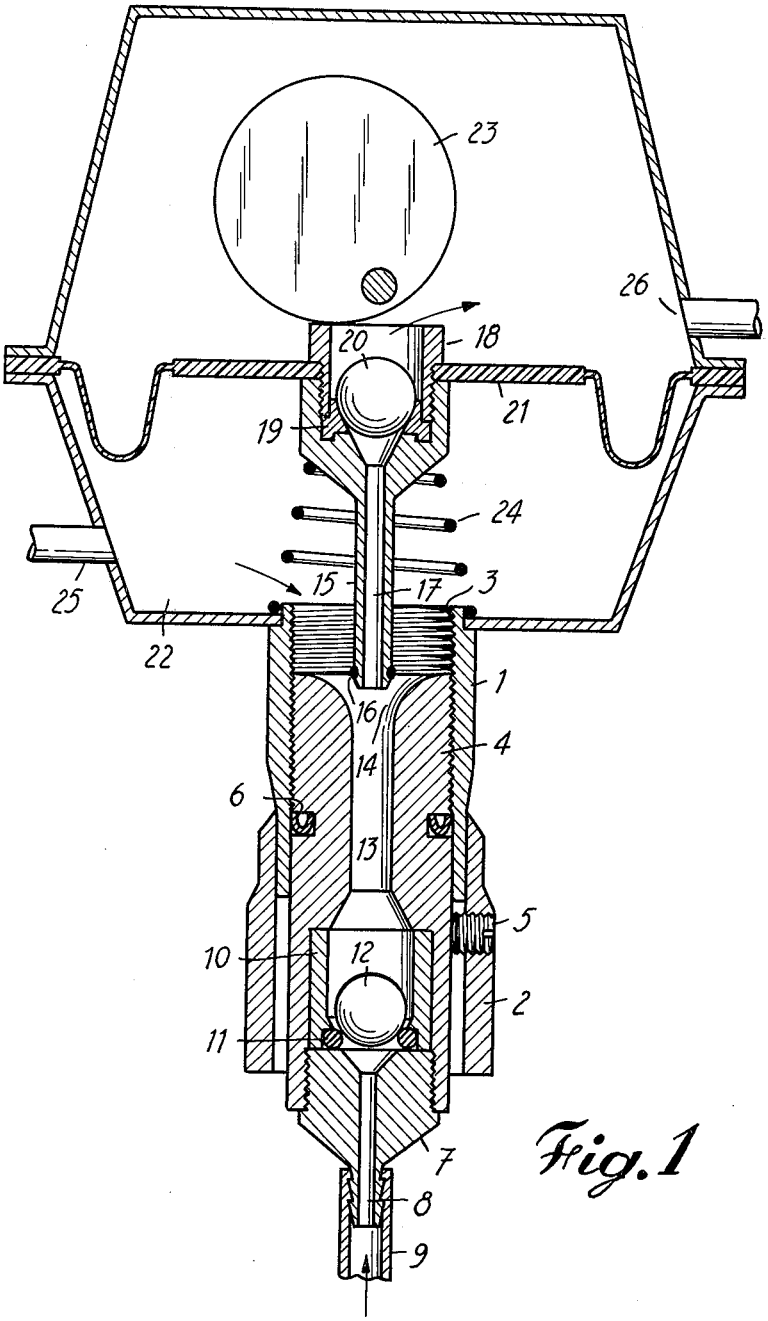
FIG. 1 shows a longitudinal section of a pump in the final position of its rising displacement.

In FIG. 1 it can be seen that the pump has a fixed housing 1 with a nozzle 2 which can be displaced upon it and that scale divisions being provided between said housing and said nozzle. Within the housing a threaded portion 3 is provided into which a cylinder 4, which is also threaded, is screwed and which can be adjusted in height as described in greater detail hereinafter. Nozzle 2 can be blocked upon cylinder 4 by means of a set screw 5, so that when nozzle 2 is rotated, cylinder 4 is displaced within the fixed housing 1, whereby this displacement can be read upon the scale divisions provided between housing 1 and nozzle 2. So as to ensure a perfect sealing between cylinder 4 and housing 1, the cylinder is provided with a sealing element 6 of any known type. At the bottom of the cylinder a nozzle 7 with central bore 8 is screwed on, upon which a hose 9 is pressed, which is let down in a container of the liquid to be pumped up. A valve housing 10 is fitted between aforesaid nozzle 7 and cylinder 4. This valve housing is provided with a ring 11 of some appropriate material upon which a ball 12 seats freely. This valve housing connects up with axial bore 13 of cylinder 4. The top free edge 14 of this opening is rounded off in order to facilitate the penetration of a plunger 15. This plunger is provided around its outer circumference with a sealing ring 16 which guarantees a perfect sealing between plunger 15 and cylinder 4. The axial bore 17 of plunger 15 leads into a valve housing 18 provided with a ring 19 and a ball 20. For the up and down movement of plunger 15 use is made of a rotated driven excentric disc 23 and of a spring 24 which presses the plunger against said disc. In this case plunger 15 is attached to a diaphragm 21 in which is for instance a part of space 22 connected to a means 25, in which there is liquid under a certain pressure.

Figure 2:
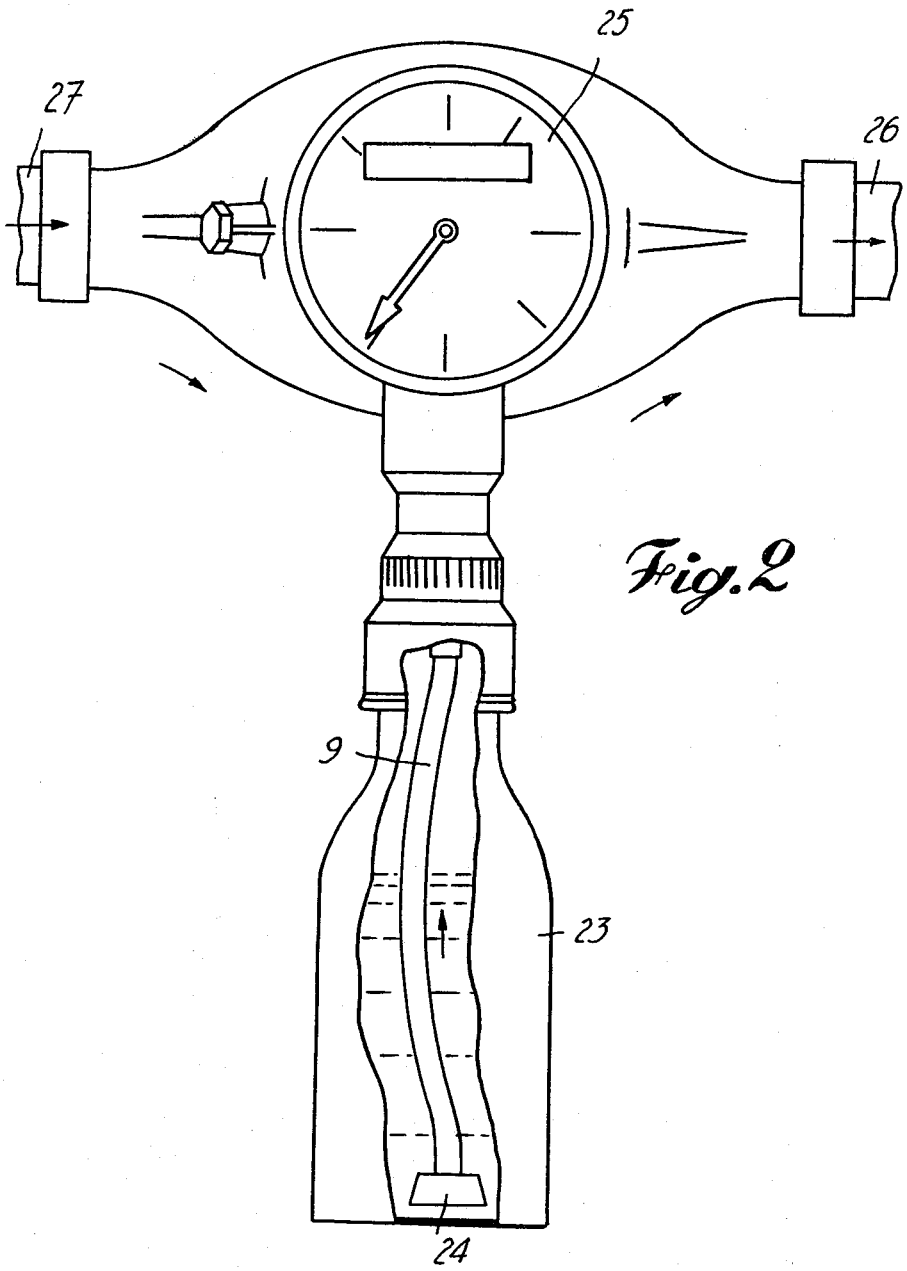
FIG. 2 shows an outside view of the pump with a volume meter and a container connected to it.

In FIG. 2 it can be seen that the pump with a volume meter 25, in which is mounted said excentric mechanism is connected to a bottle 23 containing a liquid which has to be pumped up and into which a hose 9 with filter 24 has been lowered. The pumped up liquid is evacuated via outlet 26, whereas the liquid which is at a certain pressure is entered into the pump via inlet 27.

In order to pump up a determined quantity of liquid, cylinder 4 is screwed into housing 1 by means of nozzle 2 in such a manner that the depth of penetration of plunger 15 with its reciprocating motion is determined hereby, as well as the quantity of liquid which is allowed to penetrate into cylinder 4. The scale divisions provided between housing 1 and nozzle 2 allow this adjustment to be carried out with precision. When the plunger is in its lowest position and is displaced upward by means of spring 24, the vacuum thus created will lift up ball 12 and suck up a determined quantity of liquid from bottle 23 into axial bore 13 of cylinder 4. When plunger 15 has reached its highest (FIG. (FFIG. 1), the latter is located above free edge 14 of cylinder bore 13. Consequently another liquid under a certain higher pressure, such as for instance from the water mains, will flow into this bore 13, so that the pressure of the liquid which has already been sucked up in the cylinder is raised until it reaches the pressure of the inflowing liquid, with as result that any air bubbles which may be present in the cylinder are compressed and can easily be pumped up with the liquid, so that no difficulties are encountered when pumping up the liquid. In the meantime ball 12 has closed off the central bore 8 of nozzle 7, due to the pressure exerted upon it, so that no liquid can escape from the cylinder. When plunger 15 is lowered, it penetrates into bore 13 of cylinder 4, whereby the liquid which is present in the cylinder is pressed upward through bore 17 of plunger 15. Consequently ball 20 of valve housing 18 is lifted up so that a precisely determined quantity of liquid is evacuated via valve housing 18, and opening 26 depending upon the stroke of plunger 15. Due to the fact that plunger 15 is removed out of cylinder 4 each time it reaches its highest position, the pressure in this cylinder is each time increased by the inflowing liquid at a higher pressure than that for instance, of the liquid sucked up out of bottle 23, so that a very small displacement of the plunger in the cylinder will be sufficient to pump up the liquid. This makes it possible to build the pump with relatively small dimensions.

It is perfectly obvious that the shape and the dimensions of the parts described above may differ and that certain of the previously described parts may be replaced by others which pursue the same purpose. The reciprocating movement of plunger 15 could for instance be produced also by a crank mechanism.

I claim:

1. A pump for transferring small quantities of dosed liquids, comprising a cylinder, an axial inlet bore in said cylinder for alternately receiving and discharging dosed liquid, a valve being provided at one end of said bore controlling the suction of liquid in said bore, the other end of said bore being in communication with a space for another liquid or gas at a higher pressure than the first mentioned liquid, a plunger being disposed above the other end of said inlet bore and in said space, said plunger being provided with an axial bore and a valve housing with valve for controlling the evacuation of the dosed liquid out of the inlet bore of said cylinder when the plunger penetrates in the bore of said cylinder, means for obtaining the axial displacement between said plunger and said cylinder and for bringing said plunger alternately within and without said cylinder, whereby in the latter mentioned position of said plunger the liquid which has been fed into said inlet bore of said cylinder is brought up to the same pressure as that which prevails in said space.

2. A pump as claimed in claim 1 including a fixed housing having said cylinder therein and in threaded engagement therewith whereby said cylinder can be adjusted relative to said plunger.

3. A pump as claimed in claim 1, wherein the edge of the inlet bore of said cylinder which is open at one end is rounded off towards the inside, in order to assure an easy penetration of said plunger.

4. A pump as claimed in claim 1, including a hose having one end fixed to said inlet bore at said one end of said cylinder and a free end, a filter carried at said hose free end which can be immersed in a container of the liquid which is to be drawn up.

* * * * *